US005873603A

United States Patent [19]

Carless et al.

[11] Patent Number: 5,873,603

[45] Date of Patent: Feb. 23, 1999

[54] PERSONAL GREETING CARD/POSTCARD

[76] Inventors: Tom Carless; Carolina V. Tozzi, both of 1901 Brickell Ave., #409, Miami, Fla. 33129

[21] Appl. No.: 856,870

[22] Filed: May 15, 1997

[51] Int. Cl.[6] ..... B42D 15/00

[52] U.S. Cl. ..... 283/61; 283/117; 283/116; 40/124.1

[58] Field of Search ..... 283/72, 117, 61, 283/62, 116; 40/124.1

[56] References Cited

U.S. PATENT DOCUMENTS 5,318,327 6/1994 Daneshvar ..... 283/117

5,370,422 12/1994 Richardson ..... 285/117

5,522,622 6/1996 Segar ..... 285/117

*Primary Examiner*—Willmon Fridie, Jr.

*Attorney, Agent, or Firm*—Robert M. Downey, P.A.

[57] ABSTRACT

A personal greeting card/postcard includes at least one panel having opposite faces wherein at least one of the opposite faces includes an adhesive surface and a removable protective film which covers the adhesive surface prior to use. The protective film is removed so that a personal photograph, picture or the like can be adhered to the card panel. A message and/or mailing address can be applied to the opposite face, on a second or third panel of the card or on a removable decal which removably adheres to the attached photograph.

8 Claims, 4 Drawing Sheets

PERSONAL GREETING CARD/POSTCARD

BACKGROUND OF THE INVENTION

The related art is crowded with personal greeting cards and postcards which employ the use of personal photographs. It has been found that personal photographs are more appealing to the recipient rather than a pre-generated, mass-produced photograph, picture or illustration commonly found on greeting cards or postcards.

Presently, there exists self-operated vending machines which are adapted to take a person's picture and blend it with a background scene for subsequent application on to a postcard-like substrate. In the greeting card art, there exists various greeting cards having a window formed in one panel of the card within which a personal photograph can be mounted in a manner much like a picture frame. While greeting cards of this nature do provide a personal touch, it has been found that the pictures tend to move or fall out from within the window or frame on the card. Eventually, the picture becomes separated from the card, rendering the card a meaningless keepsake.

Technology is evolving towards the generation of pictures without the use of conventional film and chemical developing. Pictures are now being captured with digital cameras in which the image is stored "electronically." This electronic picture can be manipulated by a computer and printed by special laser and dye sublimation printers in a fraction of the time of chemical processing. The present invention is designed primarily to take advantage of this emerging technology by providing the means and vehicle for converting these laser and dye sublimation printouts into viable greeting cards, postcards, and the like in a highly cost-effective manner.

SUMMARY OF THE INVENTION

The present invention is directed to a greeting card/postcard device which includes at least one panel having opposite faces, wherein at least one of the faces includes an adhesive substance on a surface thereof. A protective, removable film covers the adhesive substance prior to purchase and use of the product. Upon removing the protective film, a personal photograph on a laser or dye sublimation printout of the same general dimension of the card panel can be applied to the adhesive surface for fixed attachment thereto.

Means for including a personal message and/or a postal address can be provided on the opposite face of the card panel, on a second or third panel, or on decals which removably attach to the photograph or the surface of the card panel.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
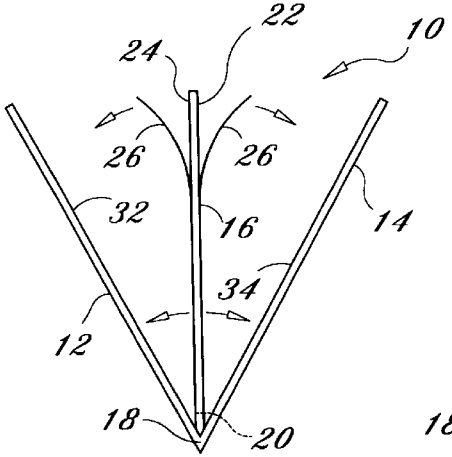
FIG. 1 is a side elevational view of a first embodiment of the present invention.
Figure 2:
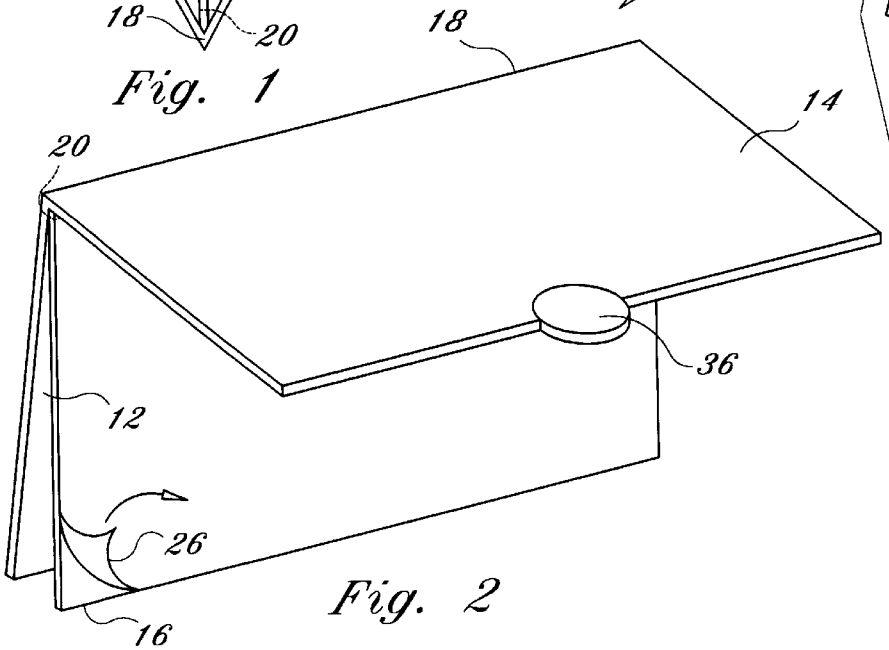
FIG. 2 is a perspective view of the embodiment of FIG. 1.
Figure 3:
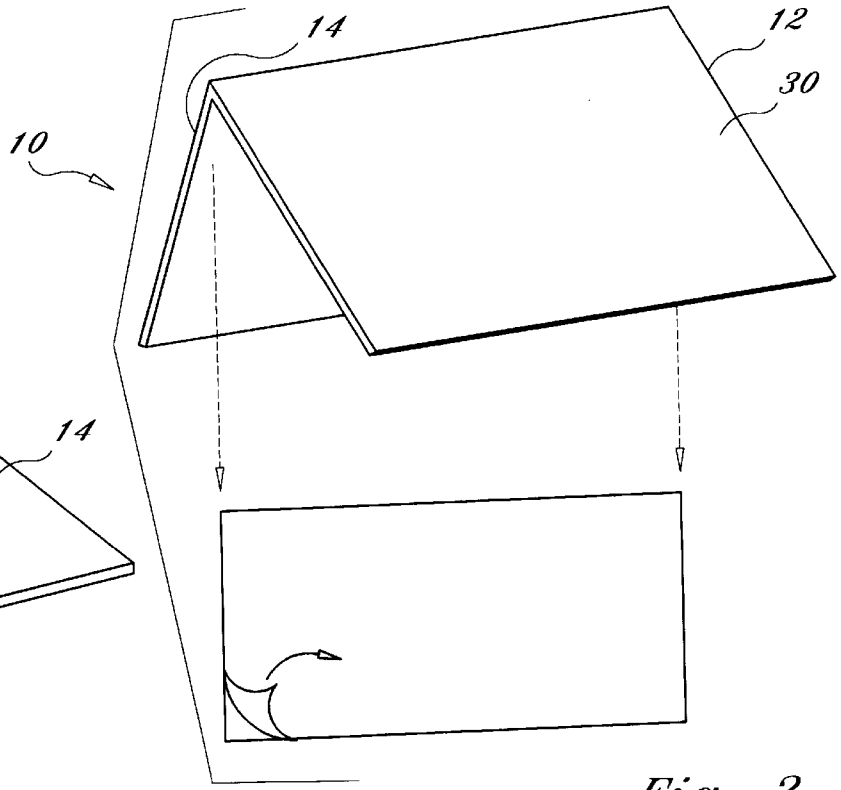
FIG. 3 is an exploded perspective view of the embodiment of FIG. 1.

Referring initially to FIGS. 1–3, there is illustrated a first preferred embodiment of the present invention directed to a greeting card device 10 having oppositely disposed outer panels 12, 14 and a center panel 16. The opposite outer panels 12, 14 are integral and hinged relative to one another at a hinge seam 18. The center panel 16 is removable, as illustrated in FIG. 3, from a remainder of the device along a perforated seam 20, adjacent the hinge seam 18. The center, removable panel 16 includes opposite faces 22, 24. Each of the opposite faces 22, 24 are provided with a layer of adhesive substance that is normally covered by a removable film 26 which peels away from the adhesive surface of the faces 22, 24, as seen throughout FIGS. 1–3. Once the film 26 is removed, a personal photograph printed on a sheet by a laser or dye sublimation printing device and having the same general dimensions as the removable panel 16 can be applied to each of the opposite faces 22, 24.

In an alternative embodiment of that shown in FIG. 1, one of the opposite faces 22, 24 of the removable center panel 16 can be provided with support means, rather than an adhesive surface, to support the panel in a generally upright position so that the picture on the opposite side is presented in a preferred orientation on a tabletop, desk, shelf or the like. This can be in the form of a fold-out stand structure of the type commonly found on small picture frames, particularly cardboard or paper frames.

Still, in another variation of the embodiment of FIG. 1, one of the opposite faces 22, 24 of the removable panel 16 can be provided with hanging means to hang the removable panel 16 on a wall surface so that the applied picture on the opposite side is viewable.

The remainder of the device 10 of the embodiment of FIGS. 1–3 can resemble a typical greeting card, wherein the front face 30 includes a general message relating to the event such as a birthday, anniversary, holiday, and the like. The inside surfaces 32, 24 of the panels 12, 14 can be used for writing a personal message, as well as applying a printed, generic message during manufacture. The outer panels 12, 14 can be secured closed with an adhesive means, such as a sealing dot 36, tape or moisture activated glue.

Referring to FIGS. 4–7, there is illustrated another preferred embodiment of the present invention directed to a personal greeting card device 10'. The device 10', as shown, includes three panels including a first panel 40, a second, central panel 42, and a third panel 44. It is noted that, while the drawings illustrate a preferred embodiment, more than three panels can be incorporated in the device 10'. At least one of the first or second panels 40, 42 is provided with the removable film 26 for protectively covering an adhesive substance on the exterior surface 45, 46, respectively. As described above in connection with the embodiment of FIGS. 1–3, the film 26 is removed to expose the adhesive substance so that a personal photograph, picture, print or the like can be fixedly attached to the respective surfaces 45, 46. If desired, both panels 40, 42 can be provided with an adhesive covered surface 45, 46 so that personal photographs can be attached on both panels.

Figure 7:
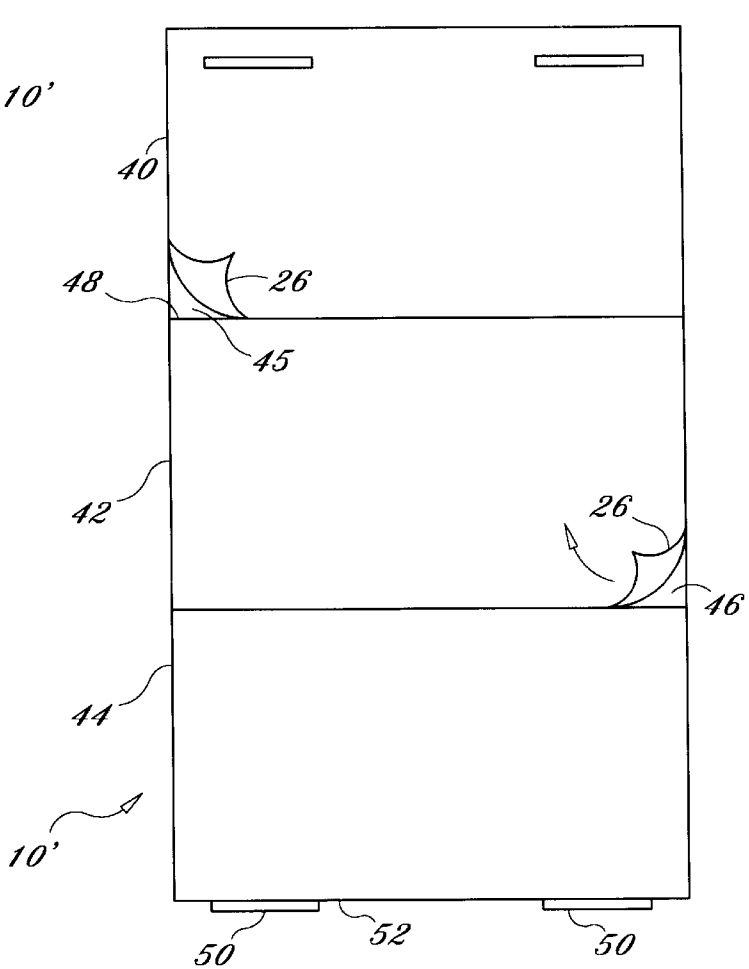
FIG. 7 is a plan view of the embodiment of FIG. 4, shown in a completely open, flat position.
Figure 5:
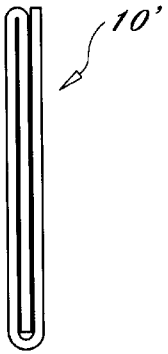
FIG. 5 is a side elevational view of the embodiment of FIG. 4 shown in a collapsed position.
Figure 4:
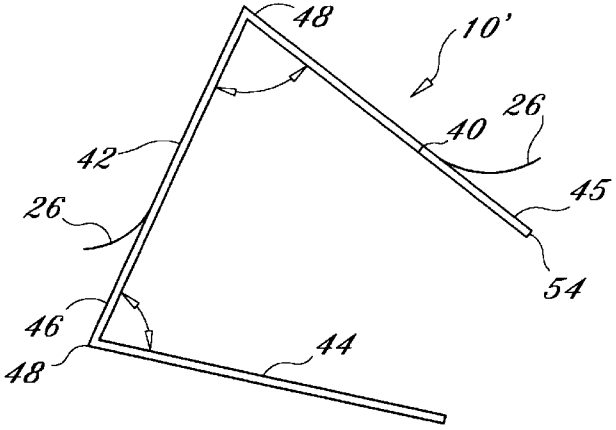
FIG. 4 is a side elevational view of another embodiment of the present invention, shown in an open position.
Figure 6:
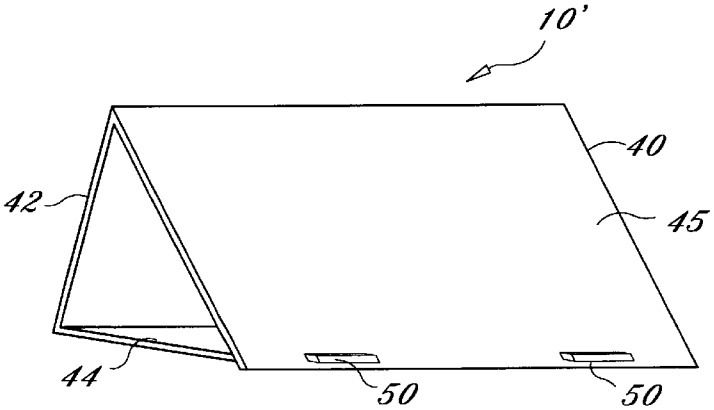
FIG. 6 is a perspective view of the embodiment of FIG. 4.

Each of the panels 40, 42, 44 are integral with one another and movable relative to one another about a hinged seam 48, as indicated by the arrows in FIG. 4. In this manner, the panels of the device 10', are movable between a collapsed, stacked orientation, as seen in FIG. 5, and a completely open, flat position as shown in FIG. 7. The third panel 44 which defines a base includes a pair of extending flaps 50 or other attachment means for securing the edge 52 of the base panel 44 to a correspondingly aligned lower edge 54 of the first panel 40 in an assembled position as illustrated in FIG. 6, wherein the first and second panels 40, 42 are presented in an angled orientation which is optimal for viewing photographs attached to the outer side surface 45, 46. In the instance that the base panel 44 includes the extending flap members 50, the lower peripheral end zone of the first panel 40 may be provided with correspondingly configured slots to receive the flaps 50 therethrough.

Figure 8:
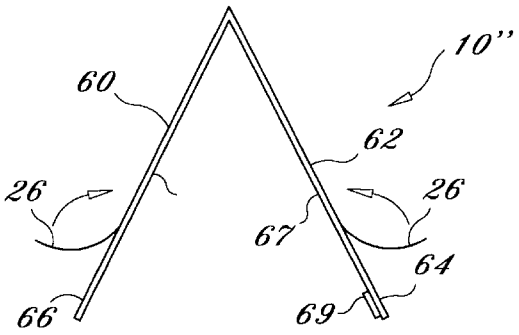
FIG. 8 is a side elevational view of yet another embodiment of the present invention.
Figure 9:
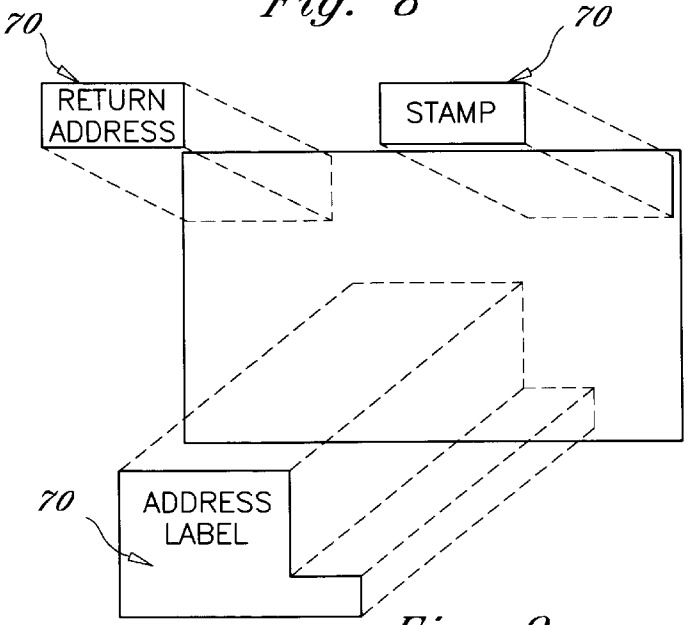
FIG. 9 is an exploded plan view illustrating removable decals for use in accordance with at least one embodiment of the present invention.
Figure 10:
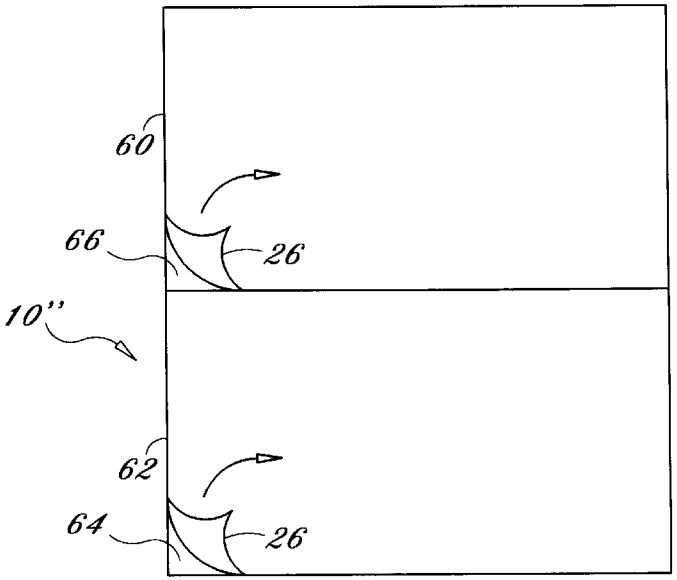
FIG. 10 is a top plan view of the embodiment of FIG. 8 shown in an open, flat position.

Referring now to FIGS. 8 and 10, there is illustrated yet another embodiment of the present invention which is directed to either a greeting card or postcard device 10". The device 10", includes two opposing panels 60, 62, each having a respective outer surface 64, 66 which includes an adhesive substance thereon, essentially the same as described above. Similarly, the protective film 26 is provided for covering the adhesive surface until it is desired to attach a personal photograph to each of the respective surfaces 64, 66 of the panels 60, 62. The device 10" can be used as either a postcard or a greeting card, wherein the inner surfaces 67, 68 of the panels 62, 60, respectively, can be used to write a personal message and/or print a generic greeting. If it is desirous to secure the panels 62, 60 together, so that the messages on the inside surfaces 67, 68 are maintained private, an adhesive means 69 can be provided towards a lower end zone of either of the panels 62, 60. In a preferred embodiment, the adhesive means 69 is a moisture activated glue composition, similar to that found on the seal of conventional envelopes, or a sealing dot like that described and shown in reference to FIG. 2. Referring to FIG. 9, removable decals are shown for use in combination with any of the embodiments of the invention shown throughout the several views of the drawings. The removable decals 70 are particularly useful for the embodiment of FIG. 8 wherein the device 10", is to be used as a postcard. In use, the removable decals 70 are applied to the surface of the attached photograph, and are removed once the greeting card/postcard is received by the recipient. In the instance the embodiment of FIG. 8 is used as a postcard, the two panels 60, 62 can be secured together using the adhesive means 69, so that the message on the inner surfaces 67, 68 remains private. Using the removable decal 70, the sender's return address, the recipient's address, and a postage stamp can be applied either directly to the photograph or, alternatively, to pre-designated areas on the outer surfaces 64, 66 of the panels 62, 60, respectively.

Figure 11:
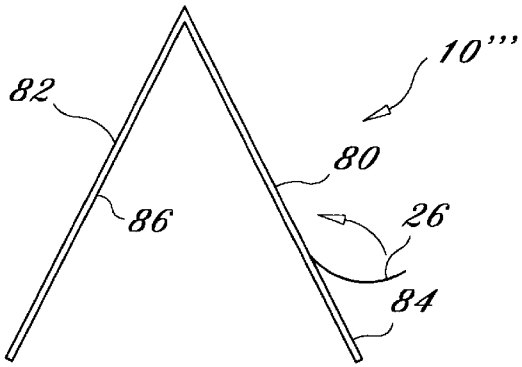
FIG. 11 is a side elevational view of still another embodiment of the present invention.

FIG. 11 illustrates yet another embodiment of the present invention which is directed primarily to a greeting card device 10'". In this embodiment, the device 10'" includes opposite panels 80, 82. One of the panels, such as 80, includes an exterior surface 84 covered by an adhesive substance, such as described above. Again, the adhesive surface 84 is protectively covered by the removable film 26, which peels away from the surface 84 so that a personal photograph, picture, print or the like can be applied and adhered to the surface 84. The opposite panel 82 acts primarily as a back panel, similar to that of conventional greeting cards, wherein an inner surface 86 is useful for applying both a personal message and a pre-printed generic greeting.

Figure 12:
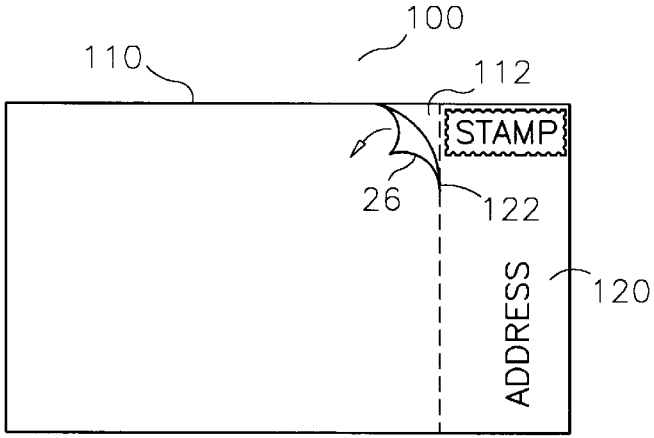
FIG. 12 is a top plan view of yet another embodiment of the present invention.

FIG. 12 illustrates still another embodiment of the present invention which is directed to a postcard 100. In the embodiment of FIG. 12, the postcard 100 includes a primary panel 110, wherein at least one side is provided with an adhesive surface 112 covered by the removable protective film 26. Similar to that described above, the film 26 is removed to apply a personal photograph, picture, and the like. A side portion 120 of the panel 110 is separated from a remainder of the panel by a perforated seam 122. The side panel 120 defines an area for applying the recipient's address and postage so that the postcard 100 can be mailed through the postal system. The opposite side of the panel 110 can be used to apply a personal message. Once the recipient receives the postcard 100, the side panel 120 can be removed from a remainder of the panel 110 by tearing along the perforated seam 122. As described above, the opposite side of the panel 110, not shown, can also be provided with stand means or hanging means so that the recipient can place the postcard 100 on a table, desk, shelf, or on a wall, in a manner which presents the picture applied to the surface 112 of the panel 110 in a preferred viewing orientation.

Figure 13:
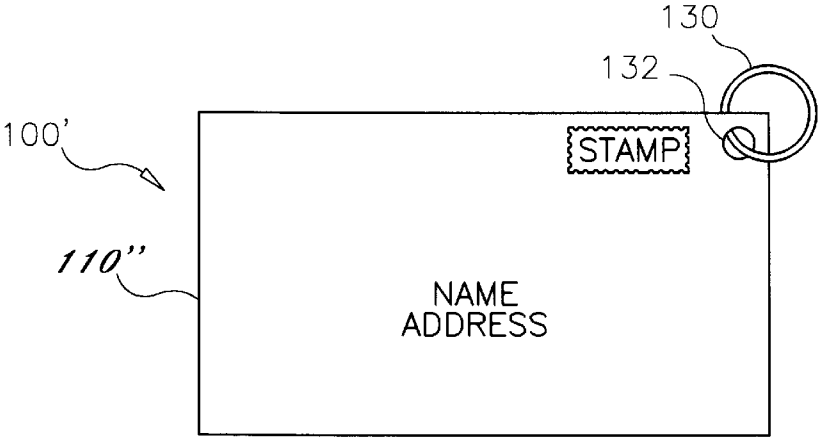
FIG. 13 is a top plan view of still another embodiment of the present invention.

FIG. 13 illustrates still another embodiment of the present invention directed to a postcard 100' having a primary panel 110' wherein at least one of the opposite faces of the panel 110' includes an adhesive surface, similar to that as described in connection with the above embodiments. This particular embodiment is characterized by a key ring 130 which is received through an aperture 132 formed through the panel 110'. The key ring 130 can be fitted through the aperture 132 for mailing or, alternatively, taped to one of the opposite faces of the panel 110 and later fitted through the aperture 132 by the recipient.

In each of the above embodiments, the device is shown to include one or more rectangular-shaped panels. The panels may take other shapes and dimensions, however, such as animal shapes, heart shapes, circles, and the like; all of which are contemplated within the spirit and scope of the present invention.

While the instant invention has been described and illustrated in what is considered to be preferred and practical embodiments thereof, it is recognized that departures may be made from the invention as disclosed which, therefore, should not be limited except within the spirit and scope of the present invention.

What is claimed is:

1. A greeting card device for use in combination with a photograph, said device comprising:

a plurality of panels including:

a first panel including an outer face and an inner face and defining a cover of said greeting card device;

a second panel including opposite faces;

a third panel having opposite faces and defining an intermediate panel between said first panel and said second panel;

said first, second and third panels being hingedly attached to one another and being foldable to assume a stacked array;

adhesive means on at least one of said second and third panels for attaching the photograph to at least one of said opposite faces thereof so that said photograph is disposed in overlying covering relation to said one of said opposite faces;

means for covering said adhesive means prior to attaching said photograph;

support means for supporting at least one of said plurality of panels in a generally upright position on a support surface in accordance with a preferred viewing orientation to permit viewing of the photograph attached thereto; and means for releasably maintaining said plurality of panels in said stacked array.

2. A greeting card device as set forth in claim 1 wherein said covering means includes a flexible film removable from at least one of said opposite faces to expose said adhesive means.

3. A greeting card device as set forth in claim 1 wherein said third panel includes means for attaching keys thereto.

4. A greeting card device as set forth in claim 1 further including means for releasably maintaining said plurality of panels in a stacked array.

5. A greeting card device for use in combination with a photograph, said device comprising:

a plurality of panels including:

a first panel including an outer face and an inner face and defining a cover of said greeting card device;

a second panel including opposite faces;

a third panel having opposite faces and defining an intermediate panel between said first panel and said second panel;

said first, second and third panels being hingedly attached to one another and being foldable to assume a stacked array;

adhesive means on at least one of said second and third panels for attaching the photograph to at least one of said opposite faces thereof so that said photograph is disposed in overlying covering relation to said one of said opposite faces;

means for covering said adhesive means prior to attaching said photograph;

said third panel including separation means for detaching said third panel from said first and second panels;

support means for supporting at least one of said plurality of panels in a generally upright position on a support surface in accordance with a preferred viewing orientation to permit viewing of the photograph attached thereto; and means for releasably maintaining said plurality of panels in said stacked array.

6. A greeting card device as set forth in claim 5 wherein said covering means includes a flexible film removable from at least one of said opposite faces to expose said adhesive means.

7. A greeting card device as set forth in claim 5 wherein said third panel includes means for attaching keys thereto.

8. A greeting card device as set forth in claim 5 wherein said opposite faces of said third panel are covered by said first panel and said second panel when said plurality of panels are disposed in said stacked array.

* * * * *